US009422787B2

(12) United States Patent
Fraser et al.

(10) Patent No.: US 9,422,787 B2
(45) Date of Patent: Aug. 23, 2016

(54) SUPPORT DEVICE FOR USE IN A WELLBORE AND A METHOD FOR DEPLOYING A BARRIER IN A WELLBORE

(75) Inventors: John Paul Fraser, Angus (GB); Jason Wing Hau Fong, Aberdeen (GB); John Kenneth Fraser Murray, Aberdeen (GB)

(73) Assignee: SMJM Limited, Aberdeen (GB)

( * ) Notice: Subject to any disclaimer, the term of this patent is extended or adjusted under 35 U.S.C. 154(b) by 336 days.

(21) Appl. No.: 14/117,408

(22) PCT Filed: May 24, 2012

(86) PCT No.: PCT/GB2012/051166

§ 371 (c)(1), (2), (4) Date: Jan. 23, 2014

(87) PCT Pub. No.: WO2012/160380

PCT Pub. Date: Nov. 29, 2012

(65) Prior Publication Data

US 2014/0238694 A1 Aug. 28, 2014

(30) Foreign Application Priority Data

May 24, 2011 (GB) ..... 1108724.4

(51) Int. Cl.

| | |
|---|---|
| ***E21B 33/13*** | (2006.01) |
| ***E21B 33/12*** | (2006.01) |
| ***E21B 23/06*** | (2006.01) |
| ***E21B 33/134*** | (2006.01) |
| ***E21B 33/127*** | (2006.01) |

(52) U.S. Cl.

CPC ..... *E21B 33/13* (2013.01); *E21B 23/06* (2013.01); *E21B 33/127* (2013.01); *E21B 33/134* (2013.01)

(58) Field of Classification Search

CPC ... E21B 33/13; E21B 33/127; E21B 33/1277; E21B 23/06

See application file for complete search history.

(56) References Cited

U.S. PATENT DOCUMENTS 2,831,540 A * 4/1958 Huber ..... E21B 23/06 166/122
2,922,478 A * 1/1960 Maly ..... E21B 33/127 166/154

(Continued)

FOREIGN PATENT DOCUMENTS

| | | | |
|---|---|---|---|
| GB | 2314359 | A | 12/1997 |
| WO | WO-96/37682 | A1 | 11/1996 |
| WO | WO-2004/067905 | A2 | 8/2004 |

OTHER PUBLICATIONS

Manolache, I., "International Search Report" for PCT/GB2012/051166, as mailed Jul. 26, 2013, 5 pages.

*Primary Examiner* — Jennifer H Gay
(74) *Attorney, Agent, or Firm* — Winstead PC

(57) ABSTRACT

The present invention relates to a downhole support device (100) for use in a wellbore and which is adapted to be run into the wellbore through an elongate member string (2) such as on a string of tubulars, a coiled tubing string or a slickline. The downhole support device comprises an inflatable element (102), which in use is adapted to be selectively connectable to the elongate member string and is further adapted to apply a biasing force in the direction of the wellbore walls. The inflatable element has an inlet (104) for receiving fluid and/or fluidized solids. The support device is further adapted to be selectively disconnectable from the elongate member string.

42 Claims, 19 Drawing Sheets

(56) References Cited

U.S. PATENT DOCUMENTS 2,942,666 A * 6/1960 Boer ..... E21B 33/127 166/120
2,978,029 A * 4/1961 True ..... E21B 23/065 166/117
3,666,011 A * 5/1972 Owens ..... E21B 33/134 166/187
5,343,956 A * 9/1994 Coronado ..... E21B 33/127 166/123
5,417,285 A * 5/1995 Van Buskirk ..... E21B 33/134 166/192
5,566,757 A * 10/1996 Carpenter ..... E21B 7/061 166/117.5
5,718,292 A * 2/1998 Heathman ..... E21B 33/1277 166/187
5,749,419 A * 5/1998 Coronado ..... E21B 23/06 166/120
6,050,336 A * 4/2000 Willauer ..... E21B 23/06 166/117
7,513,313 B2 * 4/2009 Watson ..... E21B 43/105 166/206
7,717,179 B2 * 5/2010 Rayssiguier ..... E21B 33/134 166/187
8,365,835 B2 * 2/2013 Loughlin ..... E21B 23/06 166/187
2002/0092654 A1 * 7/2002 Coronado ..... E21B 33/1208 166/369
2006/0065403 A1 * 3/2006 Watson ..... E21B 43/105 166/380
2007/0056749 A1 * 3/2007 Gambier ..... E21B 33/127 166/387
2008/0190605 A1 8/2008 Clapp et al.
2009/0183875 A1 * 7/2009 Rayssiguier ..... E21B 33/134 166/290
2010/0012314 A1 * 1/2010 Loughlin ..... E21B 33/127 166/187
2010/0230101 A1 * 9/2010 Rayssiguier ..... E21B 33/1277 166/285
2013/0105158 A1 * 5/2013 Saltel ..... E21B 33/1204 166/290
2014/0083702 A1 * 3/2014 Godfrey ..... C09K 8/422 166/295
2014/0238694 A1 * 8/2014 Fraser ..... E21B 33/13 166/382

* cited by examiner

SUPPORT DEVICE FOR USE IN A WELLBORE AND A METHOD FOR DEPLOYING A BARRIER IN A WELLBORE

The present invention relates to securing and/or suspending/abandoning cement wellbores using cement plugs or to cementing a casing structure in place, and in particular to a support device for providing a barrier which assists the formation of wellbore cement plugs or a wellbore casing cement job. The present invention further relates to a corresponding method for placing and securing a permanent or temporary plug and/or cementing to a casing in a wellbore environment.

INTRODUCTION

Hydrocarbons such as oil and gas are usually recovered from a subterranean formation using wellbores drilled into the formation. During the life of a well, it may be necessary to set a plug for sidetracking, lost-circulation control, zone isolation and/or well abandonment purposes.

Zonal isolation may be necessary in many wells and is achieved when securing casing string inside a section of the wellbore typically by pumping cement into the annular space defined by the inner surface of the wellbore wall and the outer surface of the casing string.

Well abandonment is usually considered when it reaches its economic limit and it becomes a financial liability. In this process, production tubing is removed from the cased wellbore and sections of the wellbore are generally sealed off with a cement plug (which may be many meters in height) to plug the wellbore at that location and therefore isolate the potential flow path between the various gas or oil and water zones from each other, as well as the surface.

Both procedures require some kind of barrier or support device placed inside the wellbore either temporarily or permanently, but with sufficient strength to withstand the pushing/pumping force provided by the weight of the cement placed on top of the support device.

In a particular example for abandoning or suspending a well, the so called plug cementing is an essential operation performed in accordance with regulatory guidelines under a variety of well conditions. Safety regulations require between 150 m and 300 m of a column of cement to be provided in the area to be abandoned or suspended. The column of cement is typically delivered into the wellbore via a drillstring (i.e. a string of drill pipe such as OCTG tubulars). In order to prevent slumping of the heavier cement into the well fluid below the plug, a physical barrier may be used to hold the cement in place while the cement hardens to form a plug.

FIG. 1 discloses an example of a known cement support tool (Perigon CST™ tool) 1 that is delivered to a location within the wellbore 3 via a drill pipe string 2. During delivery, the cement support tool 1 is folded together like an umbrella stored inside a transport tube 4 before it is pushed into the drill pipe string 2 using a push rod 5. The cement support tool 1 is then pushed through the drill pipe string 2 by the following cement 6 until it leaves the lower most end of the drill pipe string 2 at which point it unfolds and contacts the wellbore walls 7. In the unfolded state, a membrane 8 of the cement support tool 1 fills the inner diameter of the wellbore 3 helping to prevent wellbore fluid below the cement support tool 1 from mixing with the cement 6 that is pumped down the drill pipe string 2 into the wellbore 3.

However, the cement support tool 1 described above does not provide a particularly strong barrier due to the limited gripping force that can be provided by the unfolded wire arrangement, so that not much cement weight can be put on top of the cement support tool 1 before it moves.

Similarly, when cementing a casing in place in, for example, a gas cavern, salt cavern, coal bed methane well etc., it would be desirable to provide a simple and cost effective support structure that can be easily installed and removed.

Accordingly, it is an object of the present invention to provide a support device for use in a wellbore having improved support strength and sealing properties as well as a simplified functionality. A further object of the present invention is to provide an improved method for deploying a barrier in a wellbore.

Preferred embodiments of the invention seek to overcome one or more of the above disadvantages of the prior art.

SUMMARY OF THE INVENTION

According to a first aspect of the present invention, there is provided a downhole support device for use in a wellbore and adapted to be run into the wellbore through an elongate member string, the downhole support device comprising:

an inflatable element which in use is adapted to be selectively connectable to the elongate member string and is further adapted to selectively apply a biasing force in the direction of the wellbore walls, the inflatable element having an inlet for receiving fluid and/or fluidized solids, and wherein the device is adapted to be selectively disconnectable from the elongate member string.

The elongate member string may be any one of a string of tubulars such as a drill pipe string, a coiled tubing string or a slickline. More preferably, the elongate member string comprises one of a string of tubulars such as a drill pipe string or a coiled tubing string.

This provides the advantage that a wellbore barrier can be placed and sufficiently secured anywhere within the wellbore, either permanently or temporarily, using specifically dedicated displacement fluid, or fluid and/or fluidized solids utilized within the wellbore. For example, the displacement fluid may be cement slurry or an elastomeric compound, such as a resin, but any other suitable fluid or fluidized solid may be used. Contrary to the known prior art, which uses a complex unfolding mechanism, the support device of the present invention provides a very simple and reliable mechanism for creating a cam-like barrier that is adapted to not only support, for example, a cement slurry placed on top of the support device, but also to sufficiently seal off the wellbore in order to prevent contamination of the wellbore section below the support device during operation.

In addition, the support device of the present invention provides the advantage that the strength of the support device can be tested during installation, thus, minimizing the risk of potential damage during inflation and/or structural failure of the support device when placing the fluid and/or fluidized solids on top of the support device.

Also, delivering and securing the support device and delivering the fluid/fluidized solid, such as cement material, used within the wellbore is a seamless process, minimizing time and costs needed for deployment and subsequent constructive work inside the wellbore. Furthermore, because the inflatable element of the support device can be delivered to the predetermined location inside the wellbore in its deflated state, no further packaging or diameter reducing arrangement of the support device is necessary.

The inflatable element may be expandable. This provides the advantage that the deflated profile can be relatively small compared to the volume occupied in its inflated and expanded state.

The inflatable element may be a receptacle adapted to expand from a deflated state into a predetermined shape having at least one contact portion adapted to engage with the wall of the wellbore. Preferably, said contact portion may be substantially cylindrical with respect to the longitudinal axis of the wellbore. More preferably, the contact portion may comprise a plurality of ribs adapted to provide optimized friction and/or for sealing engagement with the wellbore wall.

This provides the advantage that the contact surface between the inner surface of the wellbore wall or inner surface of the wellbore casing/liner string and the outer surface of the support device is maximised, resulting in maximised friction and support strength between the wall and the support device. In addition, the inflatable element is capable of conforming to the profile of the wellbore wall, therefore, providing an optimized sealing engagement between the wellbore wall and the support device and minimizing the risk of contamination of the space below the support device. Ribs or any other profile patterns that are either integrally formed on or attached to the contact portion further improves the conformability of the inflatable element and increases the friction forces created between the contact portion of the support device and the wellbore/casing walls.

Advantageously, the inflatable element may be formed of a polymeric material. Polymeric material such as natural or synthetic rubber, silicon, PVC or any other suitable polymeric compound may be used, because the elastic properties allow recoverable deformation that is strong enough to withstand the stresses occurring during deployment and is readily available.

Preferably, the downhole support device may further comprise a disconnect member operatively coupled to said inflatable element and adapted to allow fluid and/or fluidized solids to flow between said string of tubulars or coiled tubing string, and said inflatable element.

The disconnect member may be operatively deployable at a bottom outlet portion of the string of tubulars or the coiled tubing string. Preferably, the disconnect member may comprise a collar portion that is typically provided on the inflatable element securable at a corresponding surface of a shoulder arrangement such as a no-go nipple assembly provided at the bottom outlet portion of the string of tubulars or coiled tubing string. More preferably, the collar portion and the no-go nipple assembly may form a fluid-tight connection.

This provides the advantage that the support device is automatically secured at the outlet portion of the string of tubulars such that the inflatable element is operatively located at the predetermined location of the wellbore, further allowing a seamless positioning, inflation, deployment disconnection process of the support device without any unnecessary steps having to be undertaken by the operator.

Advantageously, the downhole support device may further comprise a uni-directional valve operatively coupled to said inlet of said inflatable element and which preferably permits flow of fluid into the inflatable element but prevents flow of fluid out of the inflatable element. Preferably, the uni-directional valve may be adapted to open at or above a predetermined hydraulic pressure differential between the hydraulic pressure inside the string of tubulars or coiled tubing string, and the hydraulic pressure inside said inflatable element. More preferably, the uni-directional valve may be a poppet valve.

This provides the advantage that fluid can enter the inflatable element, but is prevented from flowing out of the inflatable element, so that pressure increases inside the inflatable element inflating and expanding the inflatable element towards the walls of the wellbore.

Preferably, the disconnect member may comprise a resilient release portion adapted to selectively disconnect said inflatable element from said string of elongate members at a predetermined condition. The predetermined condition may be a predetermined hydraulic pressure provided by fluid and/or fluidized solids. This provides the advantage that the portion of the support device, i.e. the disconnect member, that is compressible or collapsible can be pushed or squeezed though a lower most outlet portion of the string of tubulars of a predetermined condition, for example, when the pressure inside the inflatable element reaches a predetermined pressure limit.

The inflatable element may comprise an additive adapted to accelerate the hardening process of the fluid and/or fluidized solids received in said inflatable element.

This provides the advantage that the support device provides a secure and reliable support before further fluid is deposited on top of the support device, thereby minimizing the risk of the additional load compromising the structural integrity of the support device.

Alternatively, the downhole support device may further comprise an activation means operatively and detachably coupled to said inlet of said inflatable element and which is adapted to inflate and deflate said inflatable element upon activation. Preferably, the activation means is a piston mechanism adapted to move an internal displacement fluid into or out of said inflatable element. Even more preferably, the internal displacement fluid is an elastomeric compound. Advantageously, the inflatable element comprises an additive adapted to accelerate the hardening process of said internal displacement fluid.

Optionally, the downhole support device may further comprise a dart element operatively coupled to the bottom end of said inflatable element with respect to the direction of movement through the wellbore during delivery.

This provides the advantage that the deflated support device is assisted by the dart during delivery through the wellbore. In particular, when the support device is pumped down a string of tubulars or a coiled tubing string with the fluid and/or fluidized solids, e.g. cement slurry, it may get stuck or tilt such that the disconnect member can no longer engage with the no-go nipple arrangement of the outlet portion of the string of tubulars. The dart assists the alignment of the support device during movement through the string of tubulars or coiled tubing string to ensure correct engagement of the support device with the outlet portion, e.g. the no-go nipple arrangement.

The string of tubulars may be a drill pipe string. Alternatively, the string of tubulars may be a liner or casing string.

In yet another alternative, the disconnect member may comprise a detach mechanism adapted to detach said disconnect member from said inflatable element at a predetermined condition. Preferably, the detach mechanism may comprise a shear sleeve arrangement activated at or above a first predetermined hydraulic pressure provided by the fluid and/or fluidized solids.

This provides the advantage that the support device automatically detaches from the string of tubulars subsequently terminating the filling process of the inflatable element at a predetermined condition, for example, when the pressure inside the inflatable element reaches a predetermined pressure limit. Because the pressure inside the inflatable element translates directly to the biasing force applied to the wellbore wall, it is ensured that the support device only detaches from the string of tubulars when the support device is sufficiently secured to the wellbore walls, i.e. providing enough support for the additional load (such as a cement plug) put on top of the support device.

Alternatively, the detach mechanism may comprise a sliding sleeve arrangement activated by a drop element received by said disconnect member via the throughbore of the string of tubulars. Preferably, the drop element is a drop ball. This provides the advantage that the inflatable element can be disconnected from the string of tubulars manually, giving the operator the overriding control in case of an emergency or a device fault, therefore preventing any further damage to the support device or the wellbore.

According to a second aspect of the present invention, there is provided a method for deploying a barrier in a wellbore, comprising the steps of:

(a) providing and securing a downhole support device having an inflatable element at the bottom outlet of a string of tubulars, such that said inflatable element is positioned outside said string of tubulars at a predetermined location inside the wellbore, and (b) inflating said inflatable element, with fluid and/or fluidized solids through a first outlet port of said string of tubulars, into sealing engagement with the wellbore walls.

This provides the advantage that a sufficient support is provided during the formation of a wellbore structure such as a wellbore cement plug or during a casing cement job, wherein the support can either be integrated permanently with the plug, or temporarily installed for the duration of a casing cement job in a section of the wellbore. Furthermore, during the formation of the wellbore structure, fluid and/or fluidized solids are prevented from slumping into the space below the support structure, therefore minimizing possible contamination.

In the operation of providing a cement plug in a wellbore, the method may further comprise the steps of:

(c) detaching said inflatable element from said string of tubulars, (d) delivering an amount of fluid (which is preferably a predetermined amount of fluid) and/or fluidized solids through said first outlet port on top of said secured downhole support device, and (e) allowing the fluid and/or fluidized solids to harden, thereby to define a plug in the wellbore.

Advantageously, step (c) may be initiated by providing a predetermined hydraulic pressure at said first outlet port. Alternatively, step (c) may be initiated by a drop element provided through said string of tubulars.

Step (b) may further include providing an additive adapted to accelerate the hardening process of the fluid and/or fluidized solids received in said inflatable element.

Alternatively, in the operation of cementing a string of tubulars such as a casing or liner string, the method including steps (a) and (b) may further comprise the alternative steps of:

(c) initiating closing said first outlet port and opening at least one second outlet port to permit said fluid and/or fluidized solids in said string of tubulars to flow into a space of the wellbore above said downhole support device;

(d) delivering an amount (which is preferably a predetermined amount) of fluid and/or fluidized solids through said at least one second outlet port on top of said secured downhole support device, and (e) initiating closing said at least one second outlet port and preferably simultaneously opening said first outlet port, and initiating detaching and deflating said inflatable element from said string of tubulars.

Preferably, the at least one second outlet port and said first outlet port may be provided by a sliding sleeve mechanism. More preferably, alternative step (c) may be initiated by a first drop element provided through said string of tubulars. Even more preferably, the first drop element may be a drop ball adapted to interact with said sliding sleeve mechanism.

These alternative steps (c) to (e) provide the advantage that a casing can be cemented into place inside the wellbore using the support device to redirect the fluid and/or fluidized solids, e.g. non-hardened cement slurry, into a space or annulus defined by the outer surface of the string of tubulars to be cemented and the inner surface of the wellbore walls.

Advantageously, step (e) may be initiated by a second drop element provided through said string of tubulars. Preferably, said second drop element may be delivered by displacement fluid pushed through said string of tubulars. More preferably, the second drop element may be a wiper plug adapted to clean the inside walls of said string of tubulars.

This provides the advantage that, once the cement is in place in the said annulus and sufficiently hardened, the temporarily installed support device can be simultaneously disconnected from the string of tubulars and deflated such as to unblock the fluid flow through the wellbore. Using displacement fluid to push the wiper plug through the string of tubulars helps to sufficiently clean the inside of the string of tubulars.

BRIEF DESCRIPTION OF THE DRAWINGS

A preferred embodiment of the present invention will now be described, by way of example only and not in any limitative sense, with reference to the accompanying drawings, in which.

DETAILED DESCRIPTION OF EMBODIMENTS

Figure 1:
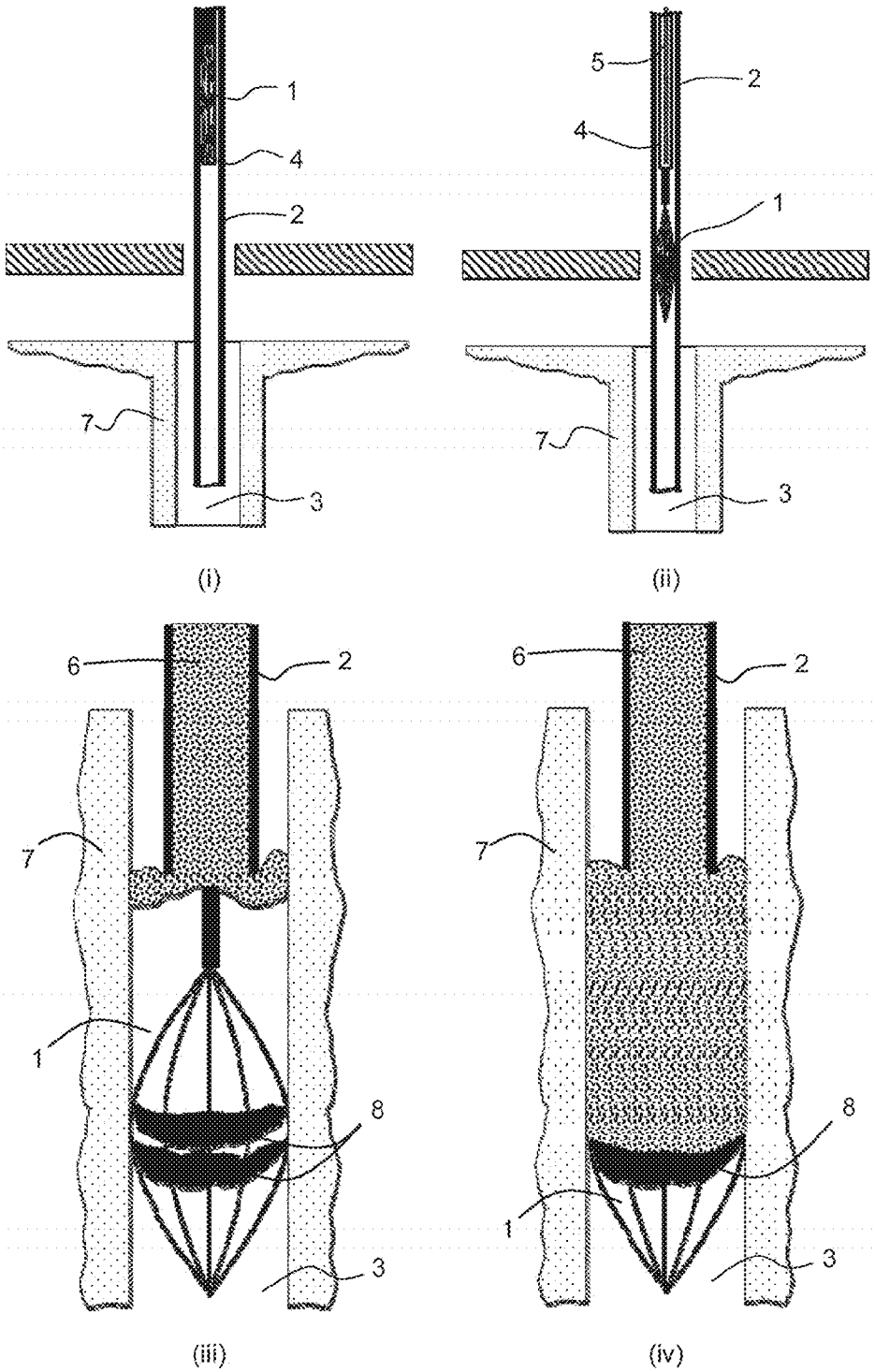
FIGURE 1 (PRIOR ART)
FIG. 1 shows a schematic sectional side view of a conventional cement support tool (Perigon™ CST): (i) inside a transport tube before it is placed into the string of tubulars, (ii) during delivery through the string of tubulars inside the wellbore, (iii) deployed at a location inside the wellbore and (iv) supporting cement slurry placed on top of the cement support tool.
Figure 2:
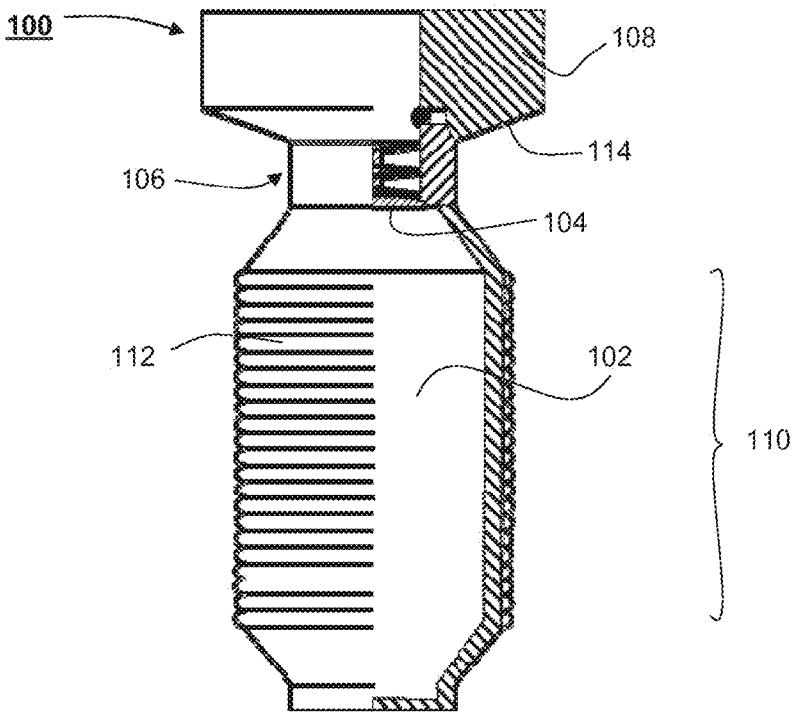
FIG. 2 shows a schematic partially sectional side view of a first embodiment of the support device in accordance with the present invention, FIG. 3 (*a*) shows a simplified schematic view of the support device of FIG. 2 in situ during delivery through a string of tubulars, FIG. 3 (*b*) shows a close-up schematic view of the support device of FIG. 2 in situ during deployment at the outlet port of the string of tubulars, FIG. 3 (*c*) shows an alternative close-up schematic view of the support device of FIG. 2 and an optional dart element in situ during delivery through the string of tubulars further comprising a dart element, FIG. 4 (*a*) shows a simplified schematic side view of the support device of FIG. 2 in situ deployed at the outlet port of the string of tubulars, FIG. 4 (*b*) shows a schematic partially sectional side view of the support device of FIG. 2 in situ during expansion of the inflatable element against the wellbore walls, FIG. 5 (*a*) shows a preferred disconnect member that is used for detachment of the support device by pushing a resilient collar portion through a no-go nipple at a predetermined hydraulic pressure provided by, for example, cement slurry, FIG. 5 (*b*) shows the inflated support member of FIG. 5 (*a*) after it is detached from the string of tubulars, wherein a displacement fluid is utilized to push/pump cement slurry through the string of tubulars and into the predetermined space of the wellbore, FIG. 6 (*a*) shows a simplified schematic side view of the support device of FIG. 2 in situ during detachment of the inflatable element from the string of tubulars using an alternative disconnect member with a detachment mechanism, FIG. 6 (*b*) shows a schematic and partly cross-sectioned side view of the support device of FIG. 2 in situ during detachment of the inflatable element from the string of tubulars and an alternative disconnect member having a detach mechanism

Referring to FIG. 2, an example of a preferred first embodiment of the support device 100 in accordance with the first aspect of the present invention is disclosed. The support device 100 comprises an expandable inflatable element 102, such as an expandable receptacle, having an inlet port 104 that is coupled to a uni-directional valve 106 detachably coupled to a disconnect member 108. The inflatable element 102 is formed from a pre-shaped polymer, such as a rubber bag, that in use is adapted to expand into a substantially cylindrical shape when inflated with a fluid, such as displacement fluid or cement slurry. The inflatable element 102 further comprises a contact portion 110 having ribs 112 suitable for gripping and sealing against a wellbore wall 120. However, it is understood that the invention is not limited to ribs and any other surface structure that improves the gripping force and/or sealing function against the wellbore wall 120 may be integrally formed with or attached to the contact portion 110 of the inflatable element 102.

Preferably, the uni-directional valve 106 is a poppet valve that is coupled to the inlet 104 of the inflatable element 102 such that fluid or fluidized solids, i.e. displacement fluid such as cement slurry or an elastomeric compound, can flow into the receptacle 102, but is prevented from flowing back out of the receptacle 102. In the preferred first embodiment shown in FIG. 2, the spring loaded poppet valve 106 opens at a differential pressure between the inside and outside of the inflatable element 102 of about 70 bars (approx 1000 p.s.i.). However, poppet valves with other suitable opening pressure differentials may be used. Also, any other suitable uni-directional valve mechanism may be used to allow fluid to flow into the inflatable element 102, but prevent it from flowing back out.

In this preferred first embodiment, the disconnect member 108 comprises a resilient release plug or collar 108 that is pushed through the bottom end or outlet port 126 of the string of tubulars or coiled tubing string when the hydraulic pressure acting on the resilient release plug 108 exceeds a predetermined pressure. The outlet port 126 comprises an inwardly projecting shoulder that has an inner diameter that is somewhat less than the outer diameter of the collar or plug 108 and therefore in the absence of fluid pressure from above, the collar or plug 108 is retained by the outlet port 126 but, if enough pressure is provided, that pressure pushes the plug or collar 108 through the outlet port 126. The hydraulic pressure required to push the disconnect member 108 through the outlet port 126 should be greater than the maximum pressure needed to fully expand and deploy the receptacle 102, so that the inflatable element 102 does not detach from the string of tubulars or coiled tubing string before it is fully inflated and deployed.

Figure 3:
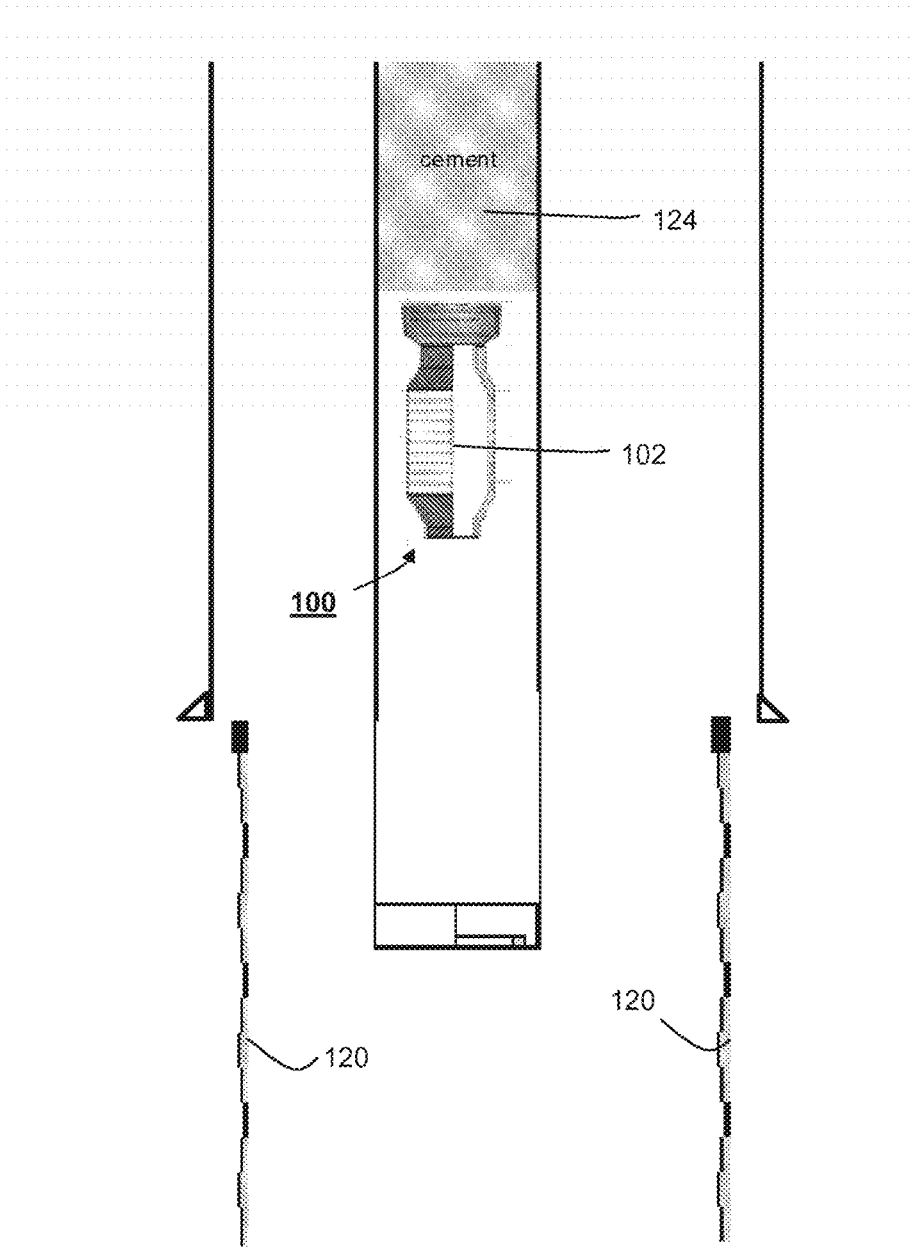
Figure 3:
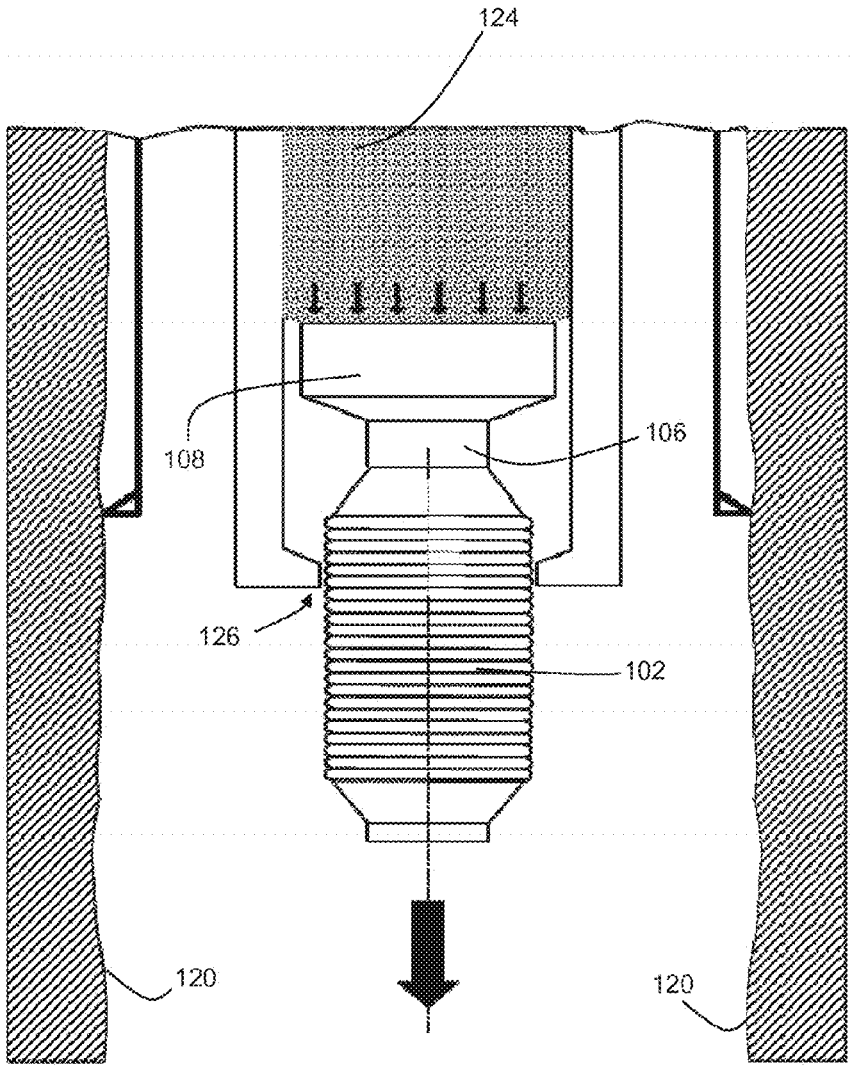
Figure 3:
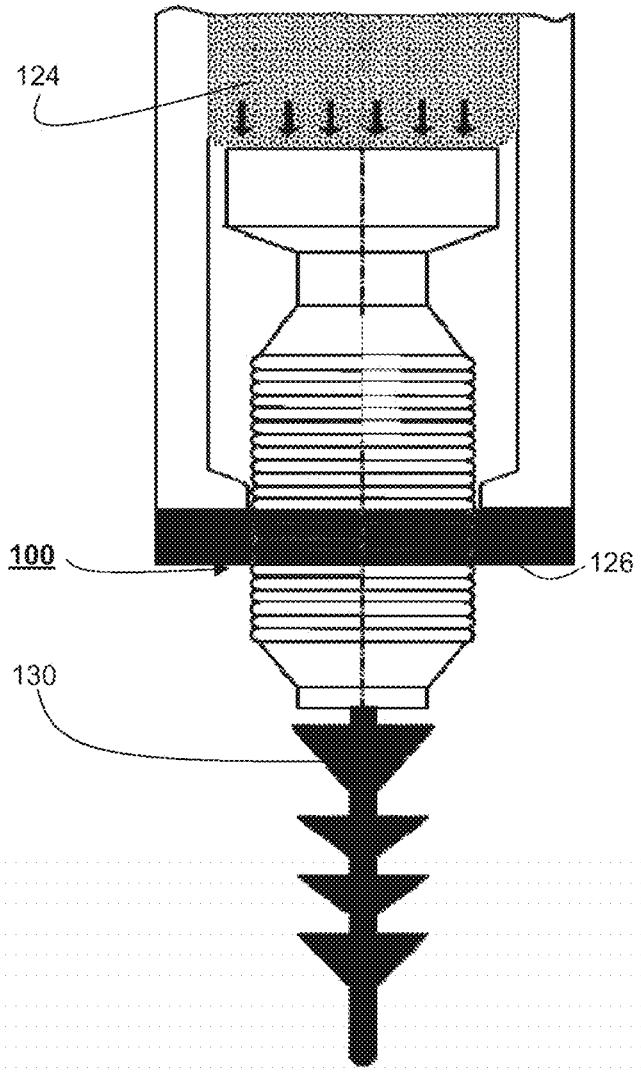

As shown in FIGS. 3 (*a*) and 3 (*b*), in order to deliver the support device 100 to a predetermined location inside the wellbore, the support device 100 is positioned inside a string of tubulars 122 (typically a work string such as a drill pipe string 122) and pumped down the drill string 122 with either cement slurry 124 or a suitable displacement fluid (not shown). Optionally, as shown in FIG. 3 (*c*), the support device 100 may be equipped with a wiper dart element 130 to stabilize the alignment of the support device 100 during delivery through the drill pipe string 122 and/or to clean the inside surface of the drill string 122 ahead of the support device 100. The dart element 130 may be attached to the front or to the lower most end of the support device 100 with respect to the direction of movement during delivery such that the support device 100 is longitudinally aligned with the flowing direction of the cement slurry 124 or displacement fluid (not shown).

Figure 4:
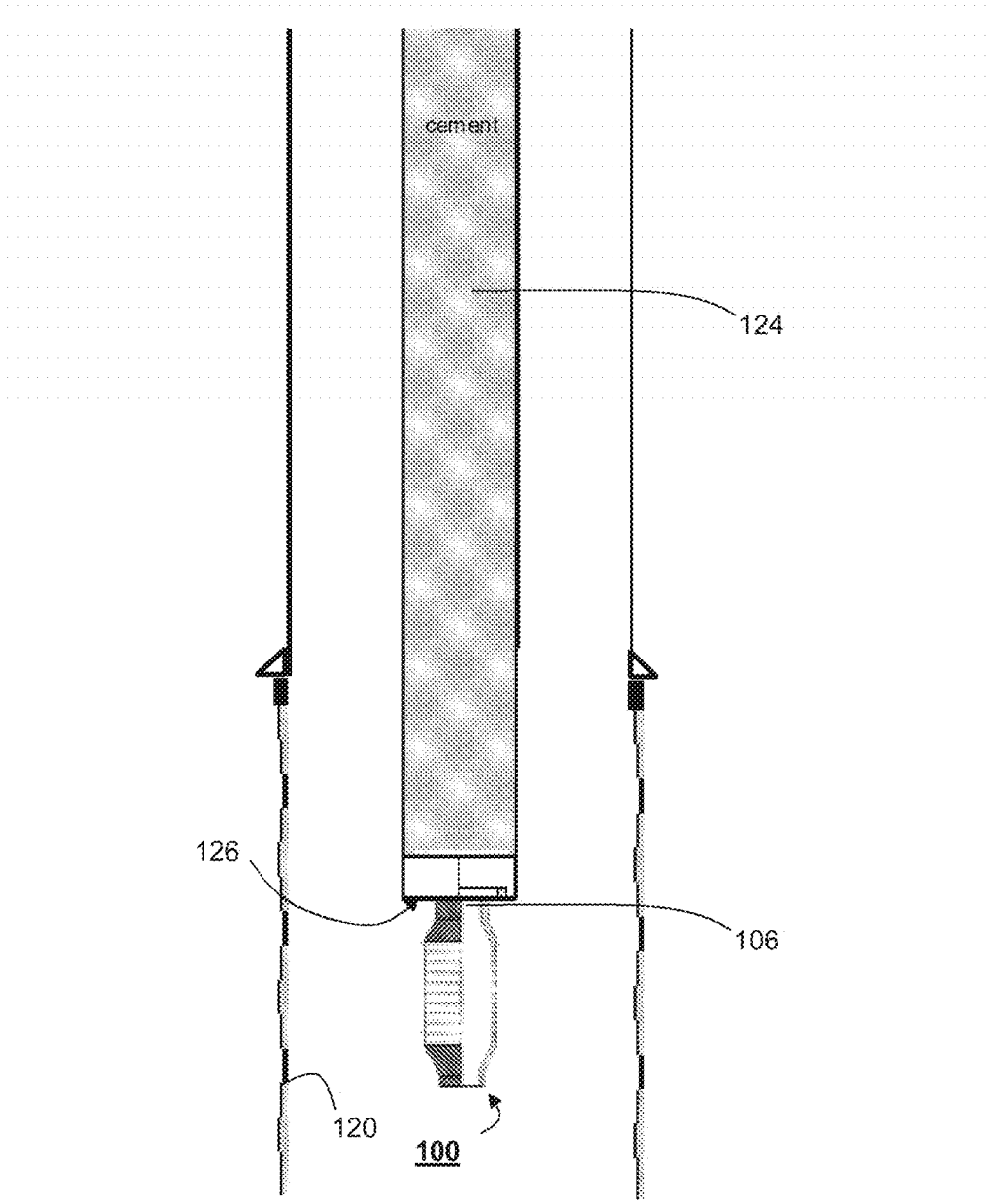
Figure 4:
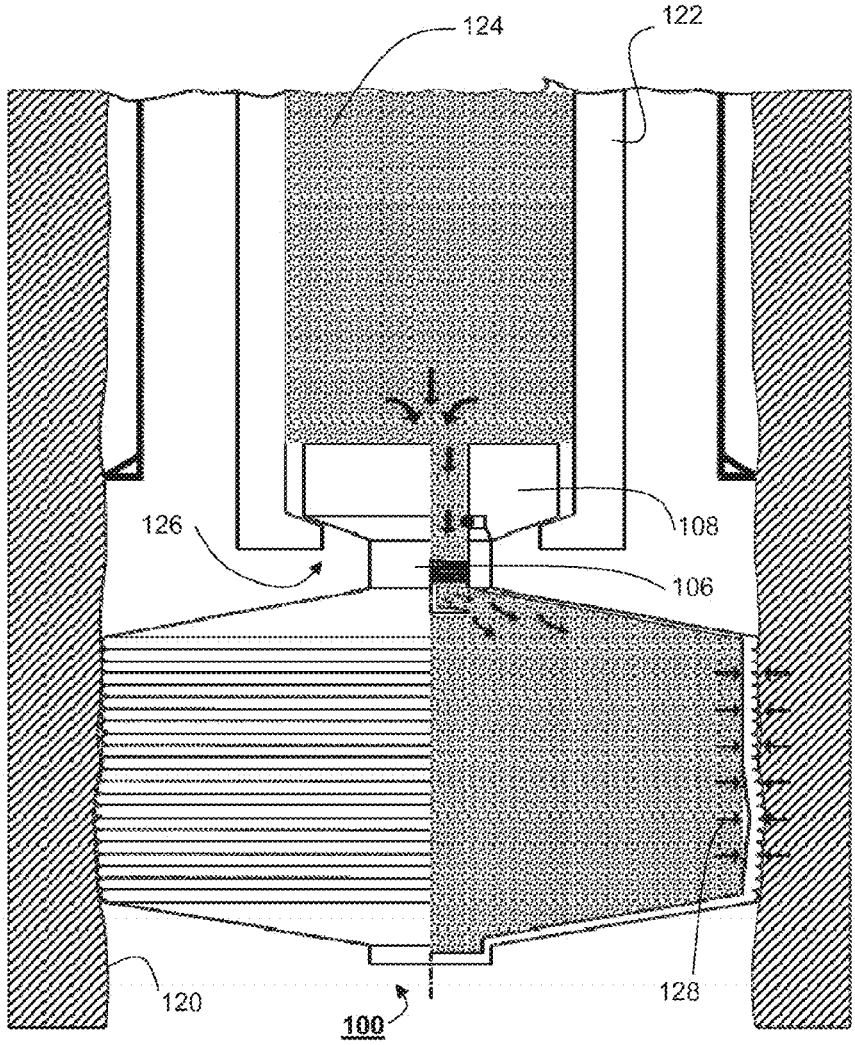

Referring now to FIGS. 4 (*a*) and 4 (*b*), the collar portion 114 of the disconnect member 108 engages a corresponding shoulder portion 127 (in the form of a no-go or landing nipple 127) of the outlet port 126 such that the uni-directional valve 106 and the inflatable element 102 are located outside the string of tubulars 122 at a predetermined location inside the wellbore. As soon as the support tool 100 is in position, the hydraulic pressure provided by the cement slurry 124 pumping down the string of tubulars 122 increases up to a predetermined pressure, e.g. 70 bar, at which point the poppet valve 106 opens and the cement slurry 124 is pushed into the inflatable element 102. The hydraulic pressure increases in response to the cement slurry 124 entering and expanding the inflatable element 102 towards the wellbore walls 120 until the contact portion 110 presses against the wellbore walls 120. At this point, due to continuing increasing pressure from the cement slurry 124 pushed through the string of tubulars 122, the biasing force 128 towards the wellbore walls 120 increases and secures the support device 100 into sealing engagement with the wellbore walls 120.

Figure 5:
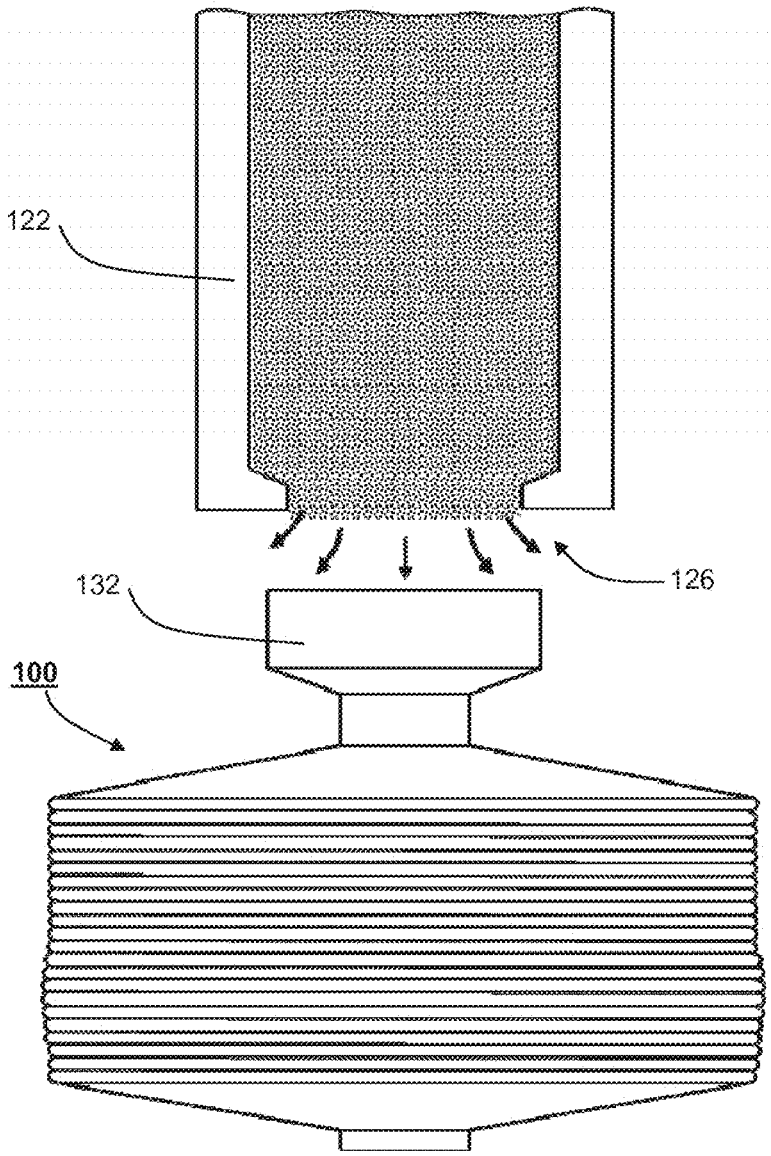
Figure 5:
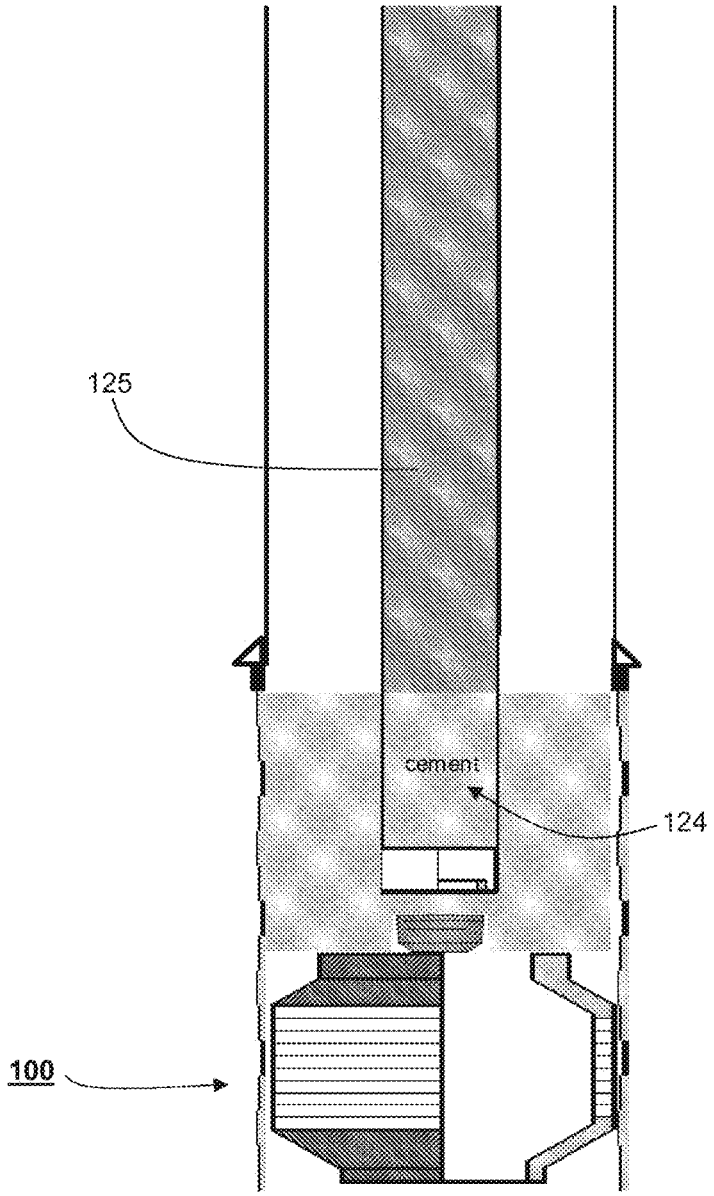

Referring now to FIGS. 5(*a*) and 5(*b*), when the predetermined pressure is exceeded, the disconnect member 108 is compressed and pushed/squeezed through the outlet port 126 of the string of tubulars 122 at a predetermined hydraulic pressure. Preferably, the disconnect member 108 is made of a resilient material that is adapted to deform such that it can squeeze through the opening of the outlet port 126 and the no-go nipple 127 of the string of tubulars 122, therefore, providing a very simple and cost effective disconnect member.

Figure 6:
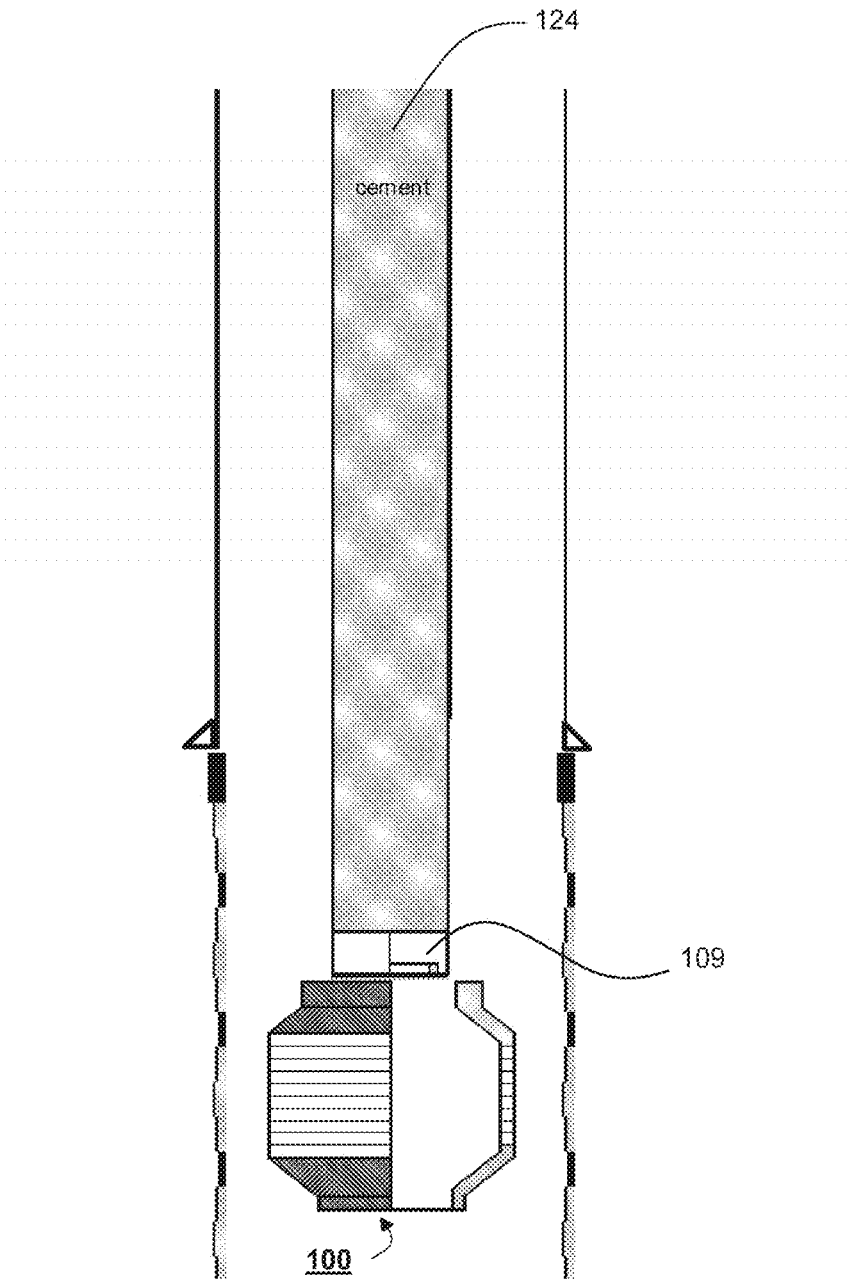
Figure 6:
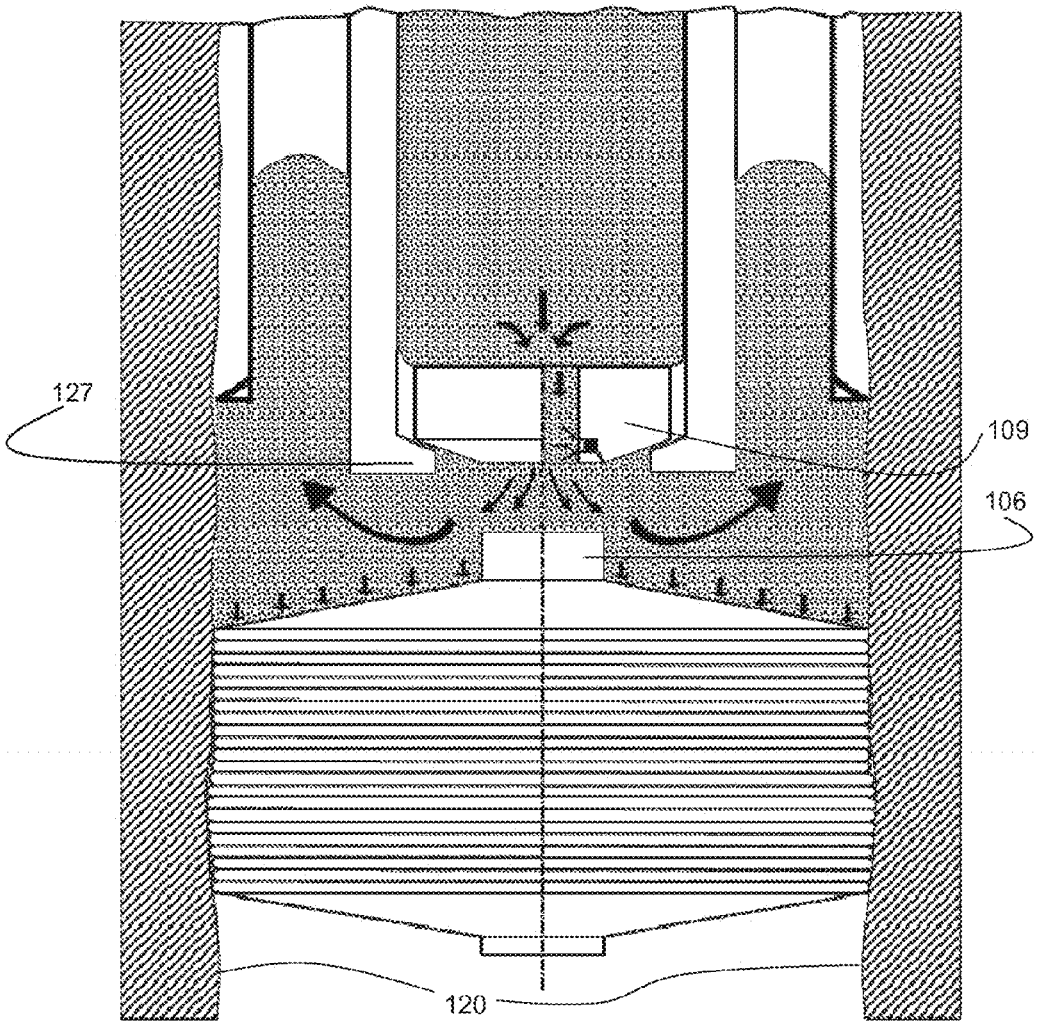

In an alternative second embodiment as shown, for example, in FIGS. 6 (*a*) and 6 (*b*), the disconnect member 108 may comprise a detach mechanism such as, for example, a shear-sleeve 109, which is activated to detach from the valve 106 and the rest of the inflatable element 102 when the hydraulic pressure in the shear-sleeve 109 exceeds a predetermined pressure, e.g. 140 bar (approximately 2000 psi), detaching the support device 100 from the string of tubulars 122. As soon as the support device 100 detaches from the disconnect member 108, the pressure differential between the inside and outside of the inflatable element 102 decreases below the predetermined pressure, e.g. 70 bar, subsequently closing the poppet valve 106.

The predetermined pressure may preferably be about 140 bar (approx 2000 psi), but any other suitable hydraulic pressure may be used. Also, the pressure required to detach the uni-directional valve 106 from the disconnect member 108 should be greater than the maximum pressure needed to fully expand and deploy the receptacle 102, so that the inflatable element 102 does not detach from the string of tubulars before it is fully inflated and deployed. In addition, the shear-sleeve 109 may be of annular shape having a collar portion 114 that is adapted to engage a no-go nipple or landing collar 127 mechanism located at the outlet 126 of the bottom end of the string of tubulars 122.

While cement slurry 124 continues to pump through and out of the string of tubulars 122 into the space on top of the deployed support device 100, the string of tubulars 122 is gradually pulled back to the surface and out of the hole until a predetermined amount of cement slurry 124, for example 150m to 300 m, is placed on top of the support device 100.

The cement slurry 124 inside and on top of the support 100 eventually hardens thereby forming a structurally secure plug inside the wellbore and which can therefore provide zonal isolation and/or suspend a port of the whole of the wellbore.

Optionally and in many instances advantageously, the receptacle 102 may be partly filled with an additive for accelerating the hardening process of cement so that the cement 124 inside the receptacle 102 sets quicker than the cement slurry 124 placed on top of the support device 100. This ensures that the support device 100 is structurally secure before placing the cement plug 124 inside the wellbore. In addition, using an additive for accelerated cement hardening inside the inflatable element 102 also prevents cement from flowing out of the inflatable element 102 after detachment from the string of tubulars 122, therefore possibly making the addition of a uni-directional valve 106 redundant and therefore not required.

Figure 7:
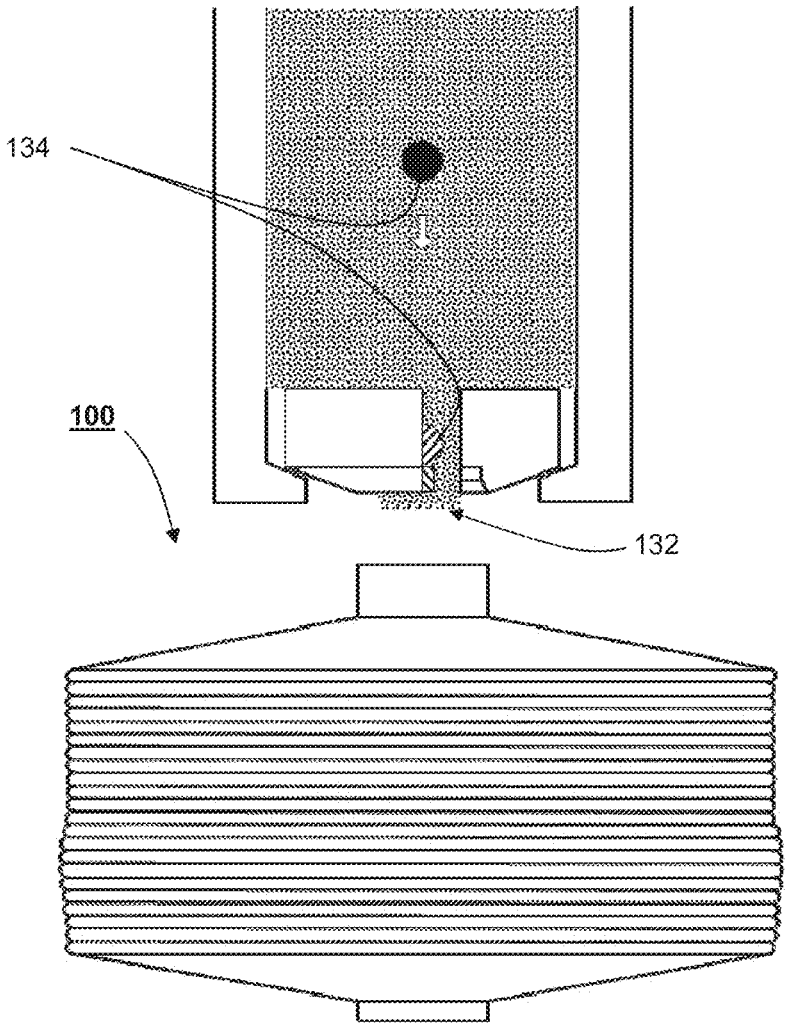
FIG. 7 shows an alternative activation (to that shown in FIG. 6(*b*)) of the detachment, wherein the detachment mechanism of the disconnect member is operated using a drop ball.

FIG. 7 shows a third embodiment of an inflatable support device 200 that comprises an alternative detach mechanism of the disconnect member 108 that can be activated manually. Preferably, the alternative detach mechanism 132 is activated by a drop ball 134 or any other drop element. This arrangement allows the operator to manually detach the support device 100 from the disconnect member 108 at any time it may be necessary.

The above described preferred first, second and third embodiments in accordance with the first aspect of the invention are preferably suited for use in a method of wellbore abandonment in accordance with the second aspect of the present invention, where a permanent cement plug is placed at a predetermined location inside a wellbore. In particular, the cement plug is formed on top of the permanently deployed support device 100 forming a sealing engagement having improved structural integrity and minimized contamination risk.

As described in the following specific example, any of the first, second or third embodiments of the support device 100 in accordance with the first aspect of the present invention may also be used in a method of cementing a casing structure in a section of a wellbore in accordance with the second aspect of the present invention. In particular, an embodiment of the support device 100 may be advantageously utilized to provide a temporary barrier assisting the cementing operation of a wellbore casing.

A method of cementing a casing liner string structure 122 inside a wellbore is now describe step-by-step referring to FIGS. 8 to 12. During operation, a support device 100 is operatively located at the outlet portion 126 of a string of tubulars 122 to be cemented in place such as a casing string 122 or a liner string 122. The support device 100 comprises an inflatable element 102 having an inlet operatively coupled to a disconnect member 108. In its deflated state, the support device 100 is adapted to be delivered through the casing or liner string 122 to the outlet port 126, where the disconnect member engages with the outlet port 126 forming a fluid tight connection between the outlet port 126 and the disconnect member 108. The string of tubulars 122 further comprises a sliding sleeve valve 136 situated adjacent to the outlet port 126 of the string 122. The sliding sleeve valve 136 is adapted to selectively direct the flow of the fluid, e.g. cement slurry 124 or displacement fluid 138, pushed through the throughbore of the casing/liner string 122 in a first direction through a first outlet port 140 towards the outlet port 126 of the casing/liner string 122, and a second direction through at least one second outlet port (not shown) (the at least one second outlet port being formed through the side wall of the sliding sleeve valve 136) into the annular space 144 defined by the outer surface of the casing/liner string 122 and the inner surface of the wellbore wall 120 above the support device 100. Preferably, the second outlet port is closed when the first outlet port 140 is open and vice versa, such that fluid can only flow through one of the first 140 or second outlet port.

Figure 8:
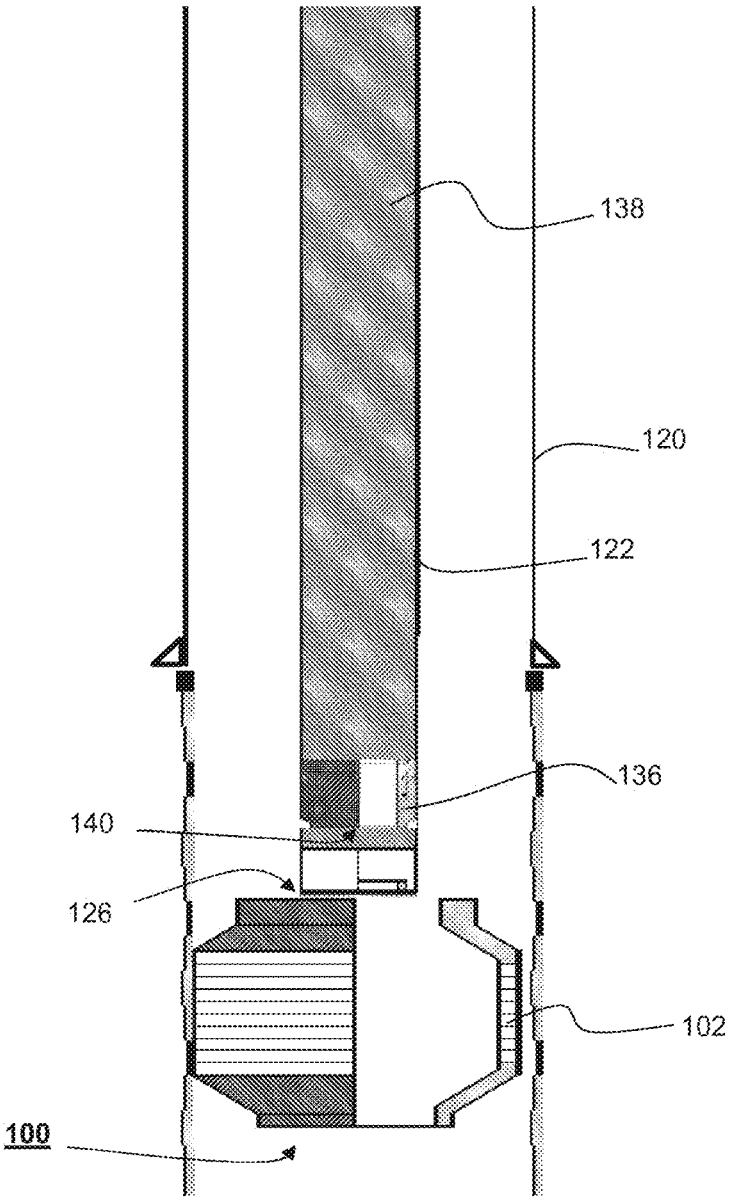
FIG. 8 shows a simplified schematic side view of a second use for the inflatable support device of FIG. 2 in cementing a casing into place inside a wellbore.
Figure 9:
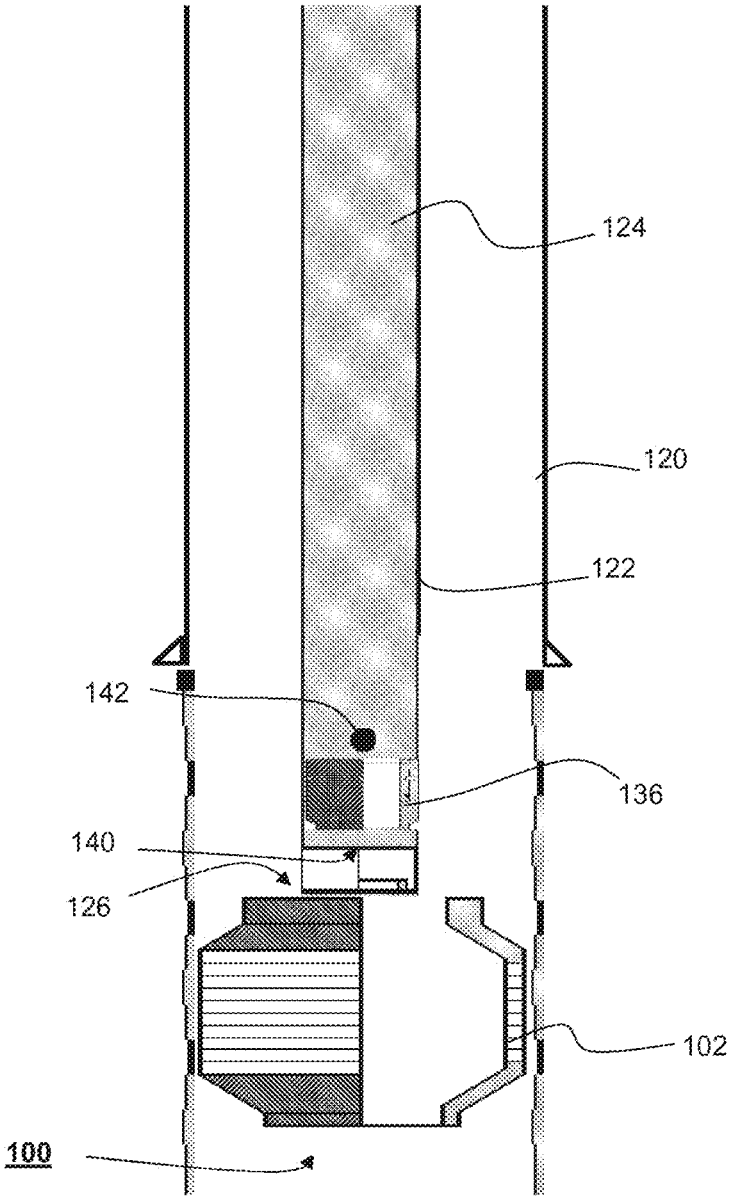
FIG. 9 shows a simplified schematic side view of the second use of FIG. 8 during the step of initialising the opening of at least one second outlet port and simultaneously closing the first outlet port of a sliding valve using a drop ball.

The support device 100 is delivered to the outlet port 126 of the string of tubulars 122 using a displacement fluid 138. When the support device 100 is positioned at the predetermined location inside the wellbore, displacement fluid 138 is pushed/pumped into the inflatable element 102 inflating and expanding the inflatable element 102 of the support device 100 into sealing engagement with the wellbore wall 120 as shown in FIG. 8. At this point, a drop ball 142 is delivered through the string of tubulars 122 into the sliding valve 136 as shown in FIG. 9 activating the sliding sleeve valve 136 to close the first outlet port 140 and simultaneously open the at least one second outlet port (not shown).

Figure 10:
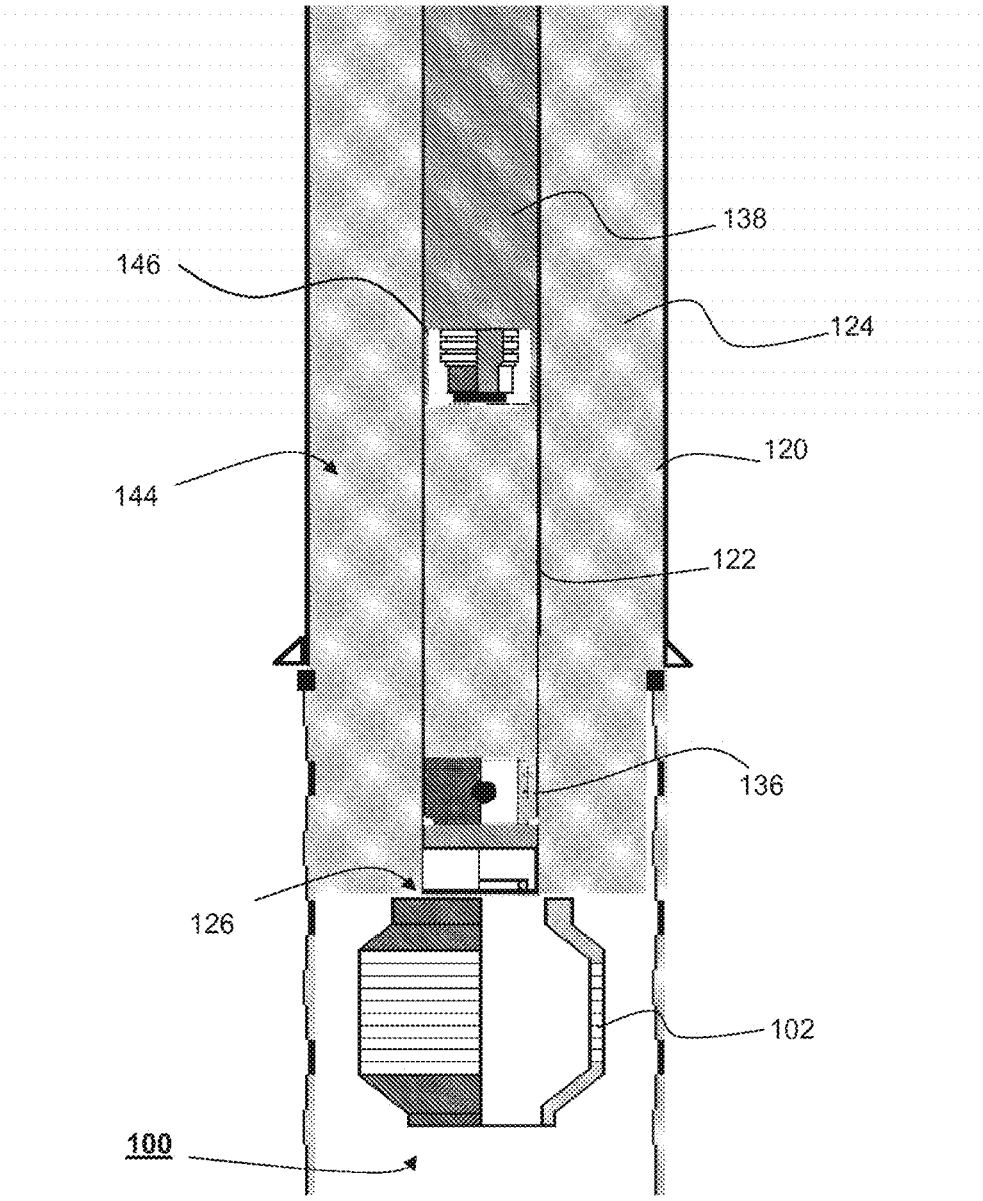
FIG. 10 shows a simplified schematic side view of the second use of FIG. 8 during of the step of pumping cement slurry through the at least one second outlet port into the annular space between the outer surface of the casing string and the inner surface of the wellbore walls utilizing displacement fluid and a wiper plug.

Thus, as shown in FIG. 10, cement slurry 124 is pumped down the throughbore of the casing/liner string 122 and flows out through the at least one second outlet port and into the annular space 144 thereby cementing the casing liner string structure 122 inside the wellbore.

Figure 11:
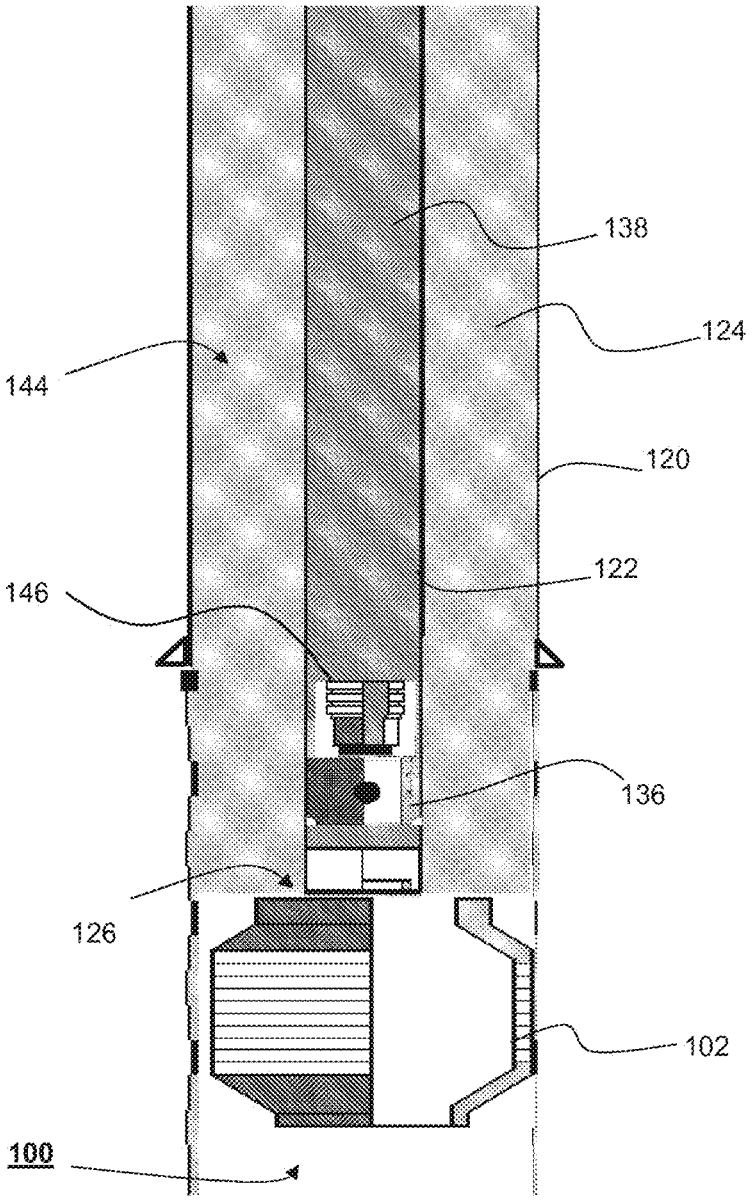
FIG. 11 shows a simplified schematic side view of the second use of FIG. 8 during the step of initializing closing the at least one second outlet port and simultaneously opening the first outlet port of the sliding valve.
Figure 12:
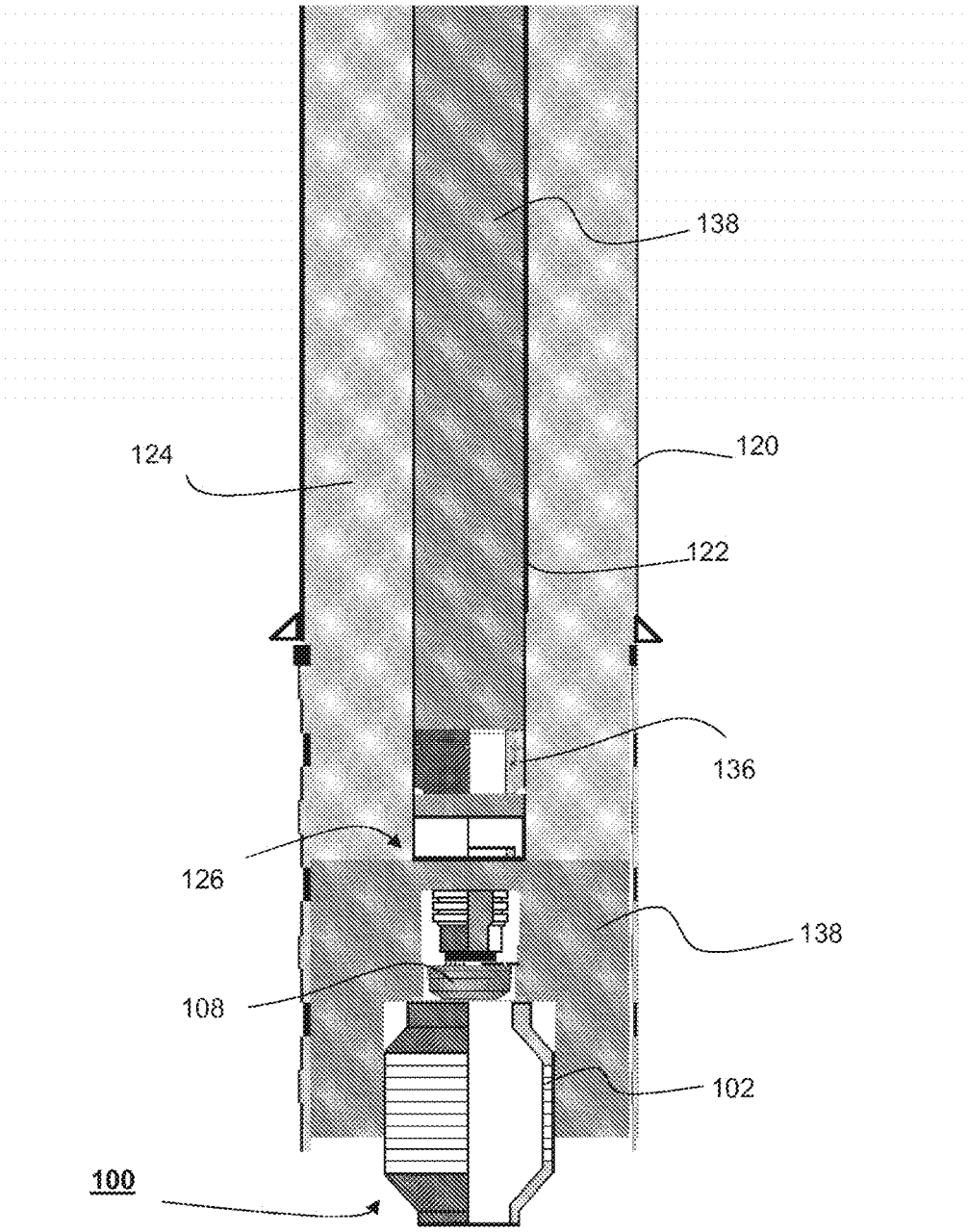
FIG. 12 shows a simplified schematic side view of the second use of FIG. 8 during the step of dispensing the support device and wiper plug from the casing string and deflating the inflatable element, FIG. 13(*a*) shows the support device of the present invention operatively coupled to a piston mechanism before inflation of the inflatable element through a piston mechanism, and FIG. 13(*b*) shows the support device of FIG. 13(*a*) after compressing the piston mechanism and inflating the inflatable element.

As shown in FIG. 11, the cement slurry 124 used for the casing cementing job is followed by a wiper plug 146 to clean the inner bore of the casing/liner string 122 which in turn is followed/pumped by displacement fluid 138 in order to push the remaining cement slurry 124 into the annular space 144 and simultaneously deliver the wiper plug 146 to the valve 136. The wiper plug 146 is adapted to engage the sliding sleeve valve 136 such as to push the drop ball 142 out of the sliding sleeve valve 136, subsequently opening the first outlet port 140 and closing the at least one second outlet port (not shown). The wiper plug 146 is then pushed through the outlet port 126 consequently pushing the drop ball 142 and the support device 100 out of the bottom end of the casing/liner string of tubulars 122. As soon as the support device 100 is disconnected from the string of tubulars 122 that have been cemented in place, displacement fluid 138 used to inflate and expand the inflatable element 102 escapes, deflating the inflatable element 102 and subsequently unblocking the wellbore, as shown in FIG. 12.

While travelling down the string of tubulars 122, the wiper plug is preferably adapted to clean the inside surface of the string of tubulars 122 to be cemented in place.

Figure 13A:
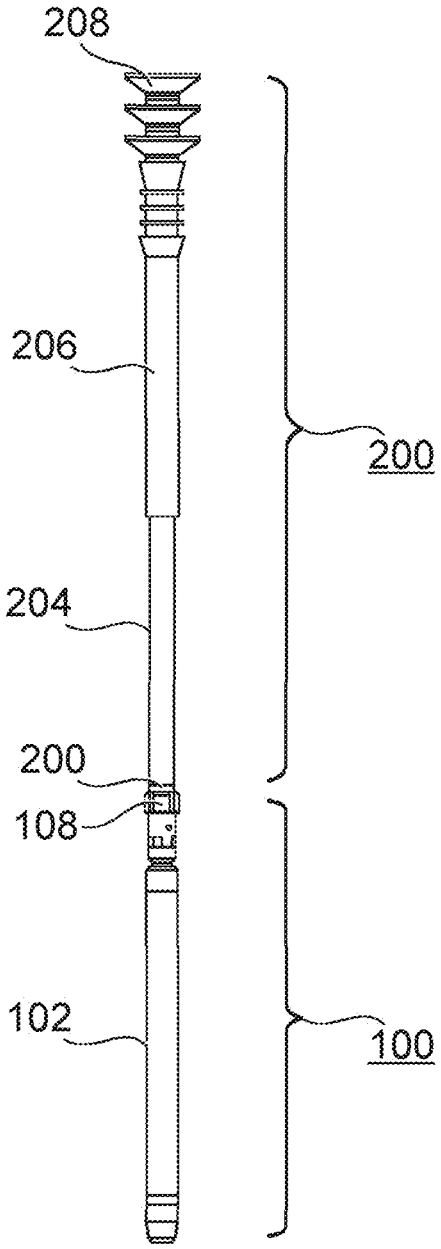
Figure 13B:
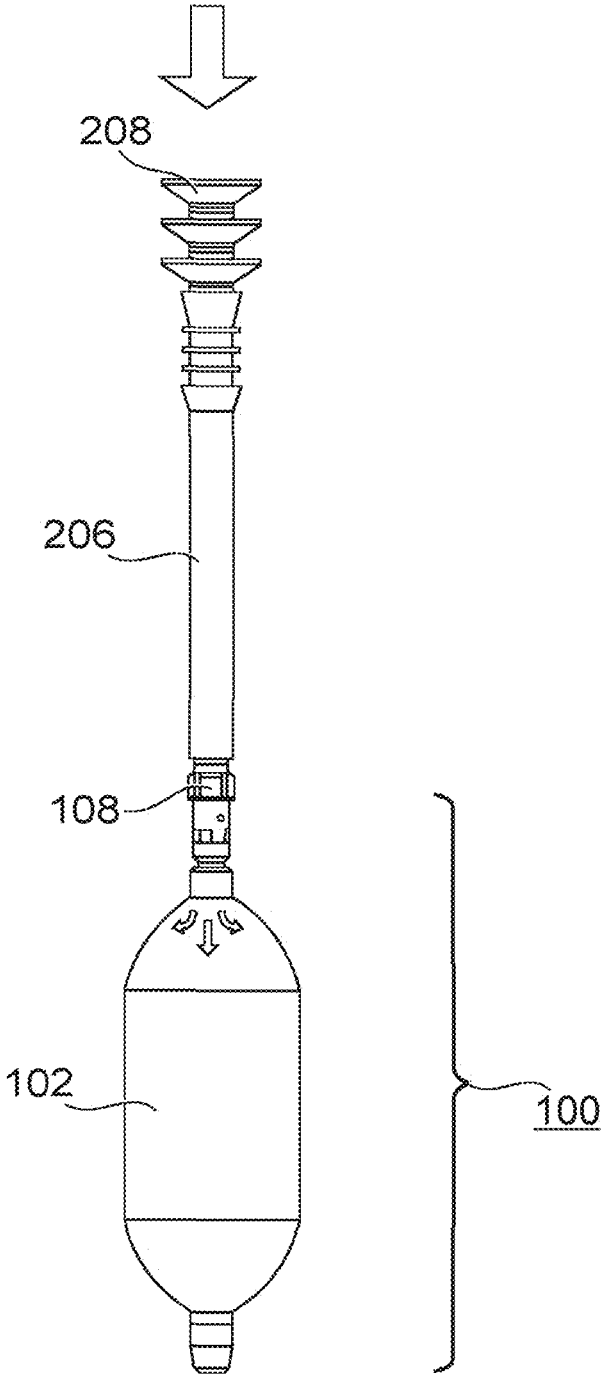

FIGS. 13(*a*) and 13(*b*) show yet another alternative fourth embodiment of an inflation support device in accordance with the present invention, in which the inlet port (not shown in FIG. 13 (*a*) or 13 (*b*), but identical to that shown in the other Figures) of the support device 100 is operatively coupled to an activation mechanism, such as, for example, a piston mechanism 200. In particular, an outlet port 202 of the piston mechanism 200 is in fluid communication with the inflatable element 102 via the disconnect member 108 and uni-directional valve (not shown in FIG. 13 (*a*) or 13 (*b*), but identical to that shown in the other Figures). The piston mechanism 200 includes a barrel portion 204 and a plunger portion 206, wherein the barrel portion 204 includes an internal displacement fluid that is used to inflate the inflatable element 102. The piston mechanism 200 further comprises a contact surface 208 at an end portion of the plunger portion 206 facing uphole of the wellbore when in situ.

During operation, the support device 100 coupled to the piston mechanism 200 is moved to a predetermined location inside the wellbore. For example, the support device 100 is moved to and located at an outlet port or lower most end of a string of tubulars 122, such as a drill pipe string 122 (not shown in FIG. 13 (*a*) or 13 (*b*), but identical to that shown in the other Figures) or coiled tubing string (not shown) using a displacement fluid, such as cement slurry or an elastomeric compound that is pumped, for example, through the string of tubulars 122. Once the support device 100 is located at the outlet port 126 so that it cannot move any further, the displacement fluid moving through the string of tubulars 122 will operate/activate the piston mechanism 200 by acting on the contact surface 208 of the plunger portion 206. The plunger portion 206 is then compressed downwards towards the barrel portion 204 and the internal displacement fluid is moved into the inflatable element 102 expanding the receptacle 102 and deploying the support device 100 within the wellbore. Once the support device 100 is deployed, the plunger portion 206 may be locked in place so that the internal displacement fluid cannot move back into the barrel portion 204. The plunger portion 206 may be locked in place by any mechanical means capable of keeping plunger portion 206 in its compressed position, such as, for example, a snap fit mechanism. The snap-fit mechanism may be adapted to open by means of a drop ball, or any other suitable remotely controllable activation means.

In the event the support device 100 needs to be removed from the wellbore, the plunger portion 206 is simply unlocked and retracted from the barrel portion 204 consequently deflating the inflatable element 102 by moving the internal displacement fluid out of the receptacle 102 and back into the barrel portion 204.

Optionally, the support device 100 and/or the coupled piston mechanism 200 may comprise a uni-directional valve and a disconnect member as described in the second and third embodiment of the present invention. Also, the inflatable element 102 may be pre-loaded with an additive to accelerated the hardening process of the displacement fluid, such as, for example, a resin or elastomeric compound. The inflation of the support device 100 of this alternative embodiment is not reversible.

During operation, the support device 100 and coupled piston mechanism 200 are loaded with the internal displacement fluid (resin or elastomer fluid type, for example) and a hardener (non-reversible option), and launched downhole. The support device 100 then latches onto the outlet port 126 at the lower end of the string of tubulars 122 or coiled tubing string (not shown). Pressure from the displacement fluid (e.g. cement slurry) compresses the plunger portion 206 therefore inflating the receptacle 102 and mixing the hardener with the resin or elastomer fluid type. Once the receptacle 102 is fully inflated, the detach mechanism of the disconnect member 108 is activated at a predetermined fluid pressure, detaching the support tool 100 from the outlet port 126 of the string of tubulars 122 and the piston mechanism 200. Resin or elastomer fluid type may be flash set, thereby providing a barrier within the wellbore.

Furthermore, it will be appreciated by persons skilled in the art that the above embodiments have been described by way of example only and not in any limitative sense, and that various alterations and modifications are possible without departing from the scope of the invention as defined by the appended claims.

The invention claimed is:

1. A downhole support device for use in a wellbore and adapted to be run into the wellbore to a pre-determined location by pumping the downhole support device through a throughbore of an elongate member string, which is already located within the wellbore, until the downhole support device is secured at an outlet portion of the elongate member string such that the downhole support device is operatively located at the predetermined location of the wellbore, the downhole support device comprising:

a disconnect member and an inflatable element the disconnect member being provided on the inflatable element and being securable at a corresponding surface provided at the outlet portion of the elongate member string to form a fluid-tight connection:

the inflatable element having an inlet for receiving fluid and/or fluidized solids and which in use is adapted to be selectively connectable to the elongate member string; and wherein said disconnect member is adapted to allow fluid and/or fluidized solids to flow between said elongate member string, and said inflatable element: wherein said inflatable member is further adapted to apply a biasing force in the direction of the wellbore walls, when inflated by said fluid and/or fluidized solids; and wherein the downhole support device is adapted to be selectively disconnectable from the elongate member string.

2. The downhole support device according to claim 1, wherein said elongate member string is one of a string of tubulars or a coiled tubing string.

3. The downhole support device according to claim 2, wherein said disconnect member is operatively deployable at a bottom outlet portion of the string of tubulars or the coiled tubing string.

4. The downhole support device according to claim 3, wherein said disconnect member comprises a collar portion that is securable at a corresponding surface of a no-go nipple assembly at the bottom outlet portion of the string of tubulars or the coiled tubing string.

5. The downhole support device according to claim 4, wherein said collar portion and the no-go nipple assembly form a fluid-tight connection.

6. The downhole support device according to claim 2, further comprising a uni-directional valve operatively coupled to said inlet of said inflatable element.

7. The downhole support device according to claim 6, wherein said unidirectional valve is adapted to open at or above a predetermined hydraulic pressure differential between the hydraulic pressure inside the string of tubulars or the coiled tubing string and the hydraulic pressure inside said inflatable element.

8. The downhole support device according to claim 7, wherein said unidirectional valve permits flow or fluid into the inflatable element and prevents flow or fluid in the other direction.

9. The downhole support device according to claim 2, wherein said string of tubulars is a work string.

10. The downhole support device according to claim 9, wherein the work string is a drill pipe string.

11. The downhole support structure according to claim 10, wherein said disconnect member comprises a resilient release portion adapted to selectively disconnect said inflatable element from said elongate member string at a predetermined condition.

12. The downhole support structure according to claim 11, wherein said predetermined condition is a predetermined hydraulic pressure provided by said fluid and/or fluidized solids.

13. The downhole support device according to claim 2, wherein said string of tubulars is a liner string.

14. The downhole support device according to claim 1, wherein said inflatable element is expandable.

15. The downhole support device according to claim 1, wherein said inflatable element is a receptacle adapted to expand from a deflated state into a predetermined shape having at least one contact portion adapted to engage with the wall of the wellbore.

16. The downhole support device according to claim 15, wherein said contact portion is substantially cylindrical with respect to the longitudinal axis of the wellbore.

17. The downhole support device according to claim 15, wherein said contact portion comprises a plurality of ribs adapted to provide optimized friction and/or for sealing engagement with the wellbore wall.

18. The downhole support device according to claim 1, wherein said inflatable element is formed of a polymeric material.

19. The downhole support device according to claim 1, wherein said inflatable element comprises an additive adapted to accelerate the hardening process of the fluid and/or fluidized solids received in said inflatable element.

20. The downhole support device according to claim 1, further comprising an activation means operatively and detachably coupled to said inlet of said inflatable element and adapted to inflate and deflate said inflatable element upon activation.

21. The downhole support device according to claim 20, wherein said activation means is a piston mechanism adapted to move an internal displacement fluid into or out of said inflatable element.

22. The downhole support device according to claim 21, wherein said displacement fluid is an elastomeric compound.

23. The downhole support device according to claim 20, wherein said inflatable element comprises an additive adapted to accelerate the hardening process of said internal displacement fluid.

24. The downhole support device according to claim 1, further comprising a dart element operatively coupled to the bottom end of said inflatable element with respect to the direction of movement through the wellbore during delivery.

25. The downhole support structure according to claim 1, wherein said disconnect member comprises a detach mechanism adapted to detach said disconnect member from said inflatable element at a predetermined condition.

26. The downhole support structure according to claim 25, wherein said detach mechanism comprises a shear sleeve arrangement activated at or above a first predetermined hydraulic pressure provided by the fluid and/or fluidized solids.

27. The downhole support structure according to claim 26, wherein said detach mechanism comprises a sliding sleeve arrangement activated by a drop element received by said disconnect member via the string of tubulars.

28. The downhole support structure according to claim 27, wherein said drop element is a drop ball.

29. A method for deploying a barrier in a wellbore, comprising the steps of:

(a) providing a downhole support device having a disconnect member and an inflatable element;

(b) pumping the downhole support device into the wellbore down through the throughbore of an elongate member string such that it is run into the wellbore through the throughbore of the elongate member string until the disconnect member is secured at an outlet portion against a corresponding surface at a lowermost end of the elongate member string, such that said inflatable element is positioned below said elongate member string at a predetermined location inside the wellbore; and (c) inflating said inflatable element by pumping fluid and/or fluidized solids from the elongate member string and into said inflatable element through an inlet of said downhole support device, such that the inflatable element is expanded into sealing engagement with the wellbore walls; and (d) activating the disconnect member such that the downhole support device is disconnected from the outlet portion of the elongate member string.

30. The method for deploying a barrier in a wellbore according to claim 29, wherein step (c) further includes delivering said fluid and/or fluidized solids via said elongate member string and out of a first outlet port of said elongate member string.

31. The method for deploying a barrier in a wellbore according to claim 30, further comprising the steps of:

(e) delivering an amount of fluid and/or fluidized solids through said first outlet port on top of said secured downhole support device, and (f) allowing the fluid and/or fluidized solids to harden, thereby to define a plug in the wellbore.

32. The method according to claim 29, wherein step (d) is initiated by providing a predetermined hydraulic pressure at said first outlet port.

33. The method according to claim 29, wherein step (d) is initiated by a drop element provided through said elongate member string.

34. The method according to claim 29, wherein step (c) further includes providing an additive adapted to accelerate the hardening process of the fluid and/or fluidized solids received in said inflatable element.

35. The method according to claim 29, further comprising the steps of:

(e) initiating closing a first outlet port and opening at least one second outlet port for said fluid and/or fluidized solids in said elongate member string into a space of the wellbore above said downhole support device;

(f) delivering an amount of fluid and/or fluidized solids through said at least one second outlet port on top of said secured downhole support device; and (g) initiating closing said at least one second outlet port and opening said first outlet port, and initiating detaching and deflating said inflatable element from said elongate member string.

36. The method according to claim 35, wherein said at least one second outlet port and said first outlet port are provided by a sliding sleeve mechanism.

37. The method according to claim 35, wherein step (e) is initiated by a first drop element provided through said elongate member string.

38. The method according to claim 37, wherein said first drop element is a drop ball adapted to interact with said sliding sleeve mechanism.

39. The method according to claim 38, wherein said second drop element is a wiper plug adapted to clean the inside walls of said elongate member string.

40. The method according to claim 37, wherein step (g) is initiated by a second drop element provided through said elongate member string.

41. The method according to claim 40, wherein said second drop element is delivered by displacement fluid pushed through said elongate member string.

42. The method according to claim 29, further comprising:

(e) pulling the elongate member string in the direction back to the surface of the wellbore.

* * * * *